US005214934A

United States Patent [19]

Palframan et al.

[11] Patent Number: 5,214,934

[45] Date of Patent: Jun. 1, 1993

[54] HELICAL CONVEYOR SYSTEMS

[75] Inventors: James Palframan, Norwich, Great Britain; James Peterson, Belle View, Wash.

[73] Assignee: York Food Systems, Inc., Issaquah, Wash.

[21] Appl. No.: 857,927

[22] PCT Filed: Apr. 17, 1990

[86] PCT No.: PCT/GB91/00603

§ 371 Date: Jul. 9, 1992

§ 102(e) Date: Jul. 9, 1992

[87] PCT Pub. No.: WO91/16582

PCT Pub. Date: Oct. 31, 1991

[30] Foreign Application Priority Data

Apr. 17, 1990 [GB] United Kingdom ..... 9008633

[51] Int. Cl.[5] ..... F25D 25/02

[52] U.S. Cl. ..... 62/381; 198/771

[58] Field of Search ..... 62/381; 198/778

[56] References Cited

U.S. PATENT DOCUMENTS

| | | | |
|---|---|---|---|
| 3,412,476 | 11/1968 | Astrom | 62/381 |
| 3,443,505 | 5/1969 | Kaufmann, Jr. | 62/381 |
| 4,164,129 | 8/1979 | Stueber | 62/381 |
| 4,480,535 | 11/1984 | Jaxmar et al. | 62/381 |
| 4,612,780 | 9/1986 | Briley et al. | 62/381 |
| 4,798,062 | 1/1989 | Lipinski et al. | 62/381 |
| 4,875,343 | 10/1989 | Jeppsson | 62/381 |
| 4,953,365 | 9/1990 | Lang et al. | 62/381 |

OTHER PUBLICATIONS

GYRoCOMPACT P42, sales brochure, "Packaged Spiral Belt Freezer", 2 pages, AGA Frigoscandia, no date.

*Primary Examiner*—Ronald C. Capossela

*Attorney, Agent, or Firm*—Finnegan, Henderson, Farabow, Garrett & Dunner

[57] ABSTRACT

A helical conveyor system in a freezing unit, wherein cold air from an evaporator (20) is fan-forced upwardly through the turns of the conveyor mesh, a primary cold air flow (26) is directed upwardly through the turns of the conveyor mesh, and a secondary flow (28) of cold air is incident on the top turn of the helix. This has the advantage that the coldest air impinges on the product while the latter is still at its warmest.

30 Claims, 1 Drawing Sheet

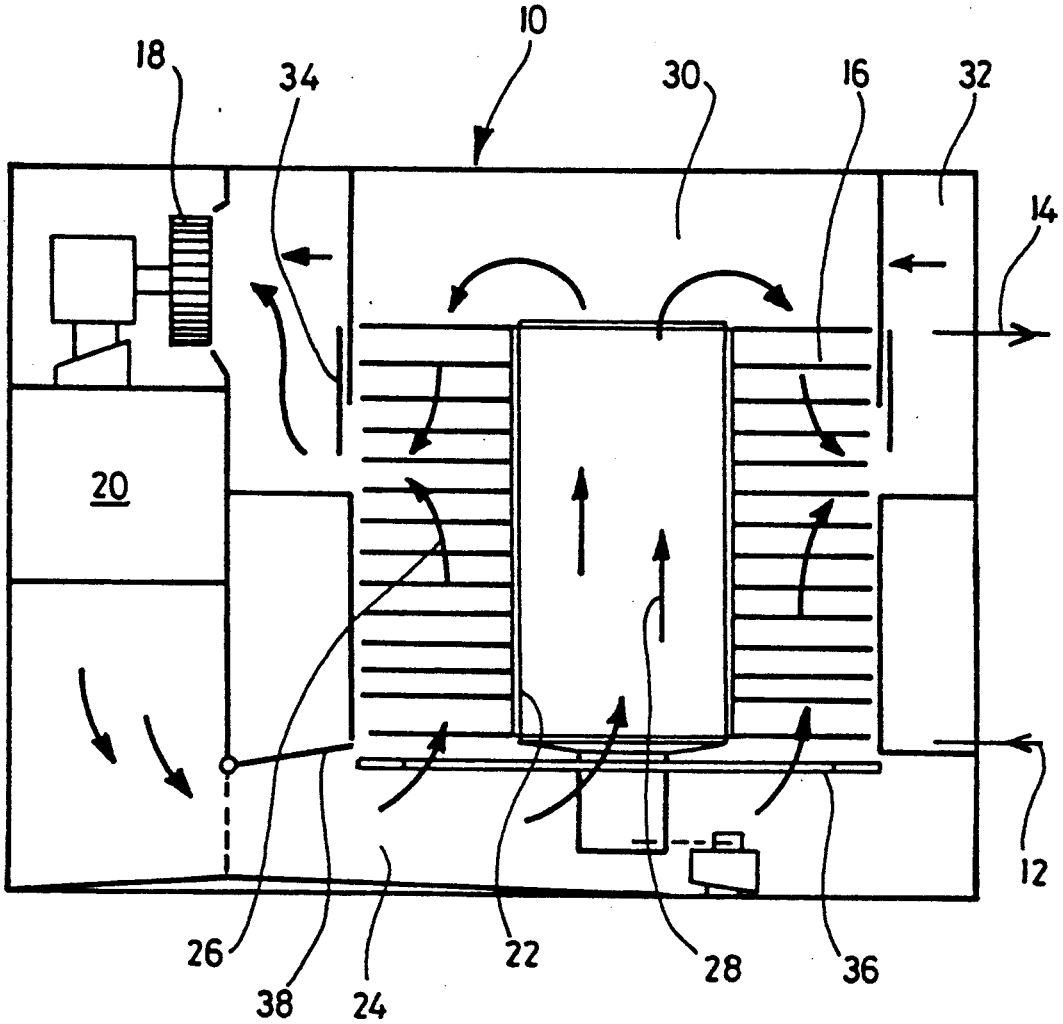
10
18
34
30
16
32
14
20
26
38
24
22
28
36
12

HELICAL CONVEYOR SYSTEMS

This invention relates generally to a helical conveying system and more especially to a controlled air flow arrangement for use in a helical conveying system employed for food freezing.

Helical conveying systems are commonly used in industrial food freezing units. The food product to be frozen is loaded on to the conveyor prior to entry of the conveyor into the bottom of its helical conveying path, is frozen whilst being conveyed upwardly along the helical conveying path, and is removed from the conveyor after the conveyor leaves the helical conveying path at the top of the helix. For freezing the product whilst being conveyed in the helical conveying path, it is exposed to cold air circulating within the freezing unit in which the helical conveying path is located. The conveyor is typically endless, and returns to the bottom of the helix outside the freezing unit.

A typical belt is of flexible wire mesh, and usually the cold air is blown through the conveyor, over its helical conveying path, from top to bottom of the helix, directly contacting the product to be frozen as it penetrates downwardly through the successive tiers or turns of the conveyor mesh.

Known controlled air flow arrangements are generally inefficient, and control of the flow of cold air is relatively elementary, so that turbulence sometimes occurs in the generally downward path of the air flow, leading to unreliable and non-uniform freezing of the product.

It is a general aim of this invention to provide a helical conveying system with an improved cold air flow arrangement.

According to the invention, there is provided a helical conveyor system in a freezing unit, wherein cold air from an evaporator is fan-forced upwardly through the turns of the conveyor mesh, a primary cold air flow is directed upwardly through the turns of the conveyor mesh, and a secondary flow of cold air is incident on the top turn of the helix.

Preferably the secondary flow passes downwardly through the upper few turns of the helix, both primary and secondary flows emerging from the side of the helical conveying path for return to the fans and evaporator. In this case shutter means is preferably provided at the exit of the air flow from the side of the helical conveying path.

A preferred conveying system utilises a drum or capstan located on the inside of the helix to drive the conveyor mesh in its helical path. In the preferred arrangement, the secondary air flow passes upwardly through the drum to emerge at the top thereof and be diverted radially outwardly and downwardly to be incident on the top turn of the helix. A secondary shutter means, for example in the form of an adjustable ring diaphragm, may be provided beneath the bottom turn of the helix to control the relative amounts of air in the primary and secondary flows. Upstream of the secondary shutter means, a closable baffle may be provided for completely closing off air flow from the evaporator, for example to enable defrosting.

The invention has the advantage that the coldest air direct from the evaporator impinges on the product whilst the latter is still at its warmest, i.e. at the bottom of the helix, rapidly sealing in moisture in the product, reducing dehydration and increasing yield. Moreover, the air flow can be quantitatively controlled to suit the product being frozen. The secondary air flow, of air still near to its coldest, ensures that the product is fully frozen immediately before leaving the freezing unit.

A helical conveyor system in accordance with the invention is now described by way of example with reference to the accompanying drawing, the single figure of which shows the system diagrammatically from the side, as seen from the interior of a freezer unit.

The freezer unit in which the system is incorporated is basically a closed housing 10, with entrance 12 for the conveyor and exit 14 for the conveyor. The housing 10 also has various not shown access doors.

The conveyor is an endless flexible wire mesh belt, for example of the Ashworth type. Within the freezer unit, it follows a helical path the turns or tiers of which are referenced 16, the belt entering the helix at the bottom and leaving it at the top. The belt has a return path (not shown) from top to bottom outside the freezer unit.

A food product to be frozen is loaded on to the conveyor at the entrance 12, and the frozen product is removed from the conveyor at exit 14. The product is frozen in the course of its path along the helical upward path of the conveyor belt within the freezer unit, and for this purpose is chilled by a flow of cold air. This air is caused to circulate in controlled manner within the freezer unit by means of a fan 18 which is associated with an evaporator 20, both installed within one side of the housing 10.

In the context of this invention, the helical path conveying system may take any one of several different forms. Preferably, however, and as illustrated, it is driven in its helical path by a rotating capstan or drum 22 mounted within the helix, with or without use of a supplementary driving means at the return path outside the freezer unit. The belt may be supported by a helical guide at the outside edge of the helix. in conjunction with cantilever arms extending inwardly from the guide to support the belt across its full width at appropriate intervals along its helical path of movement. Alternatively, a simple guide rail may be provided at the outside edge of the helix, the belt having spacer plates at its inside edge whereby any one turn of the helix is, at said inside edge, supported by the turn next below. As a further alternative the outside edge of the helix may be supported by spacer plates which are apertured to allow the passage of cold air. In each case, the arrangement is such that the helix is open to the exterior between its turns, at the outside edge.

The drum 22 may drive the belt directly, or via a narrow supplementary conveyor which is self-supporting by means of spacers and which in turn drives the inner edge of the product conveyor, and which may at the same time support the inner edge of the product conveyor.

This invention is concerned, more especially, with an arrangement for controlling the cold air flow which freezes the food product in course of its helical path of movement.

In accordance with the invention, the cold air emergent evaporator 20 enters a space 24 beneath the conveyor helix and drum, and impinges directly on the lowest turn of the helix, thence to pass a primary air flow 26 upwardly through the turns of the wire mesh belt. A secondary air flow 28 passes upwardly through the inside of the drum.

In order to maintain separation between the primary and secondary air flows, 26, 28, the drum may have a solid internal wall surface. However, if the conveyor belt is self-supporting by spacer plates at its inside edge, these plates may themselves be sufficient to define a closed wall to the outside edge of the conveyor, in which case it is not essential for the drum to have a closed cylindrical wall.

The secondary air flow emerges into a space 30 above the drum and, within said space, is turned radially outwardly and downwardly to impinge on the top turn of the helix. The primary and secondary air flows thence emerge together, from the open outside edge of the helix, a few turns below the top thereof, into an annular space 32, from there to be drawn back through the fan 18 to the evaporator 20.

A shutter means 34 in the space 32, in practice taking the form of arcuately segmental plates vertically adjustable between T-bars, for example, enables the total air flow to be quantitatively controlled. A supplementary shutter 36 in the space 24, for example in the form of an adjustable ring diaphragm, enables the relative amounts of air in the primary and secondary flows to be quantitatively adjusted.

Conveniently, a hinged baffle 38 is also provided for shutting off the space containing the conveyor system from the evaporator exit, for example to facilitate defrosting.

The shutter means 34, diaphragm 36 and baffle 38 may be manually adjustable or may be power controlled.

When the above-described system is in use, the air first incident on the product, at the bottom turn of the helix, is very cold air direct from the evaporator, so that the outside layer of the product is very quickly frozen to seal moisture inside and avoid risk of product dehydration. Moreover, the air incident on the product at the top turn of the helix, just before the product emerges from the freezer unit, is also very cold air, and acts to ensure that the product is fully frozen. The shutters 34, 36 ensure that the air flow can be closely controlled to suit any specific product being handled. It is also found that the carefully controlled air path flows do not give rise to turbulence which can lead to non-uniform product treatment.

Various modifications of the above-described and illustrated arrangement are possible within the scope of the invention as hereinbefore defined.

We claim:

1. A helical conveyor system for cooling or freezing a product comprising:

a conveyor for conveying the product, said conveyor including a belt in a form of a helix with a plurality of turns and having a top and a bottom;

a housing enclosing the conveyor, said housing having side walls and a top and a bottom;

refrigeration means for providing cold air;

flow path means in communication with said refrigeration means for introducing a flow of cold air to both the bottom and top of the conveyor simultaneously, to thereby provide two-sided cooling of the product as it is transported from the bottom of the conveyor to the top; and exit means formed in the housing through which the cold air can flow after it passes over the product.

2. A helical conveyor system for cooling or freezing a product comprising:

a conveyor for conveying the product, said conveyor including a belt in a form of a helix with a plurality of turns and having a top and a bottom;

a housing enclosing the conveyor, said housing having side walls and a top and a bottom;

refrigeration means for providing cold air;

primary flow path means in communication with said refrigeration means for directing a primary flow of cold air into the housing and upwardly from the bottom of the conveyor through turns of the conveyor;

secondary flow path means in communication with said refrigeration means for directing a secondary flow of cold air along a flow path different than the primary flow path, the secondary flow being introduced to the conveyor adjacent the top of the conveyor; and exit means formed in the housing through which the cold air flows after it has been directed along the primary and secondary flow paths.

3. The system of claim 2 wherein said secondary flow path means causes the secondary flow to pass over the top of the conveyor and downwardly through a few upper turns of the conveyor to a position where the secondary and primary flows merge.

4. The system of claim 3 wherein said exit means comprises an opening formed in the side of the housing through which the merged primary and secondary flows exit from said housing.

5. The system of claim 4 further comprising means for selectively controlling the air flow through said opening in the side of the housing.

6. The system of claim 2 further comprising means for controlling the primary and secondary flows of cold air.

7. The system of claim 6 wherein said controlling means includes a first selectively variable device for controlling flow into said housing, said device being positioned below the bottom of said conveyor.

8. The system of claim 7 wherein said controlling means further includes a selectively variable flow device positioned between the bottom of said conveyor and the bottom of said housing.

9. The system of claim 8 wherein said selectively variable flow device comprises an adjustable ring diaphragm.

10. The system of claim 6 wherein said controlling means includes a selectively variable flow device positioned between the bottom of said conveyor and the bottom of said housing.

11. The system of claim 6 wherein said controlling means includes a selectively variable flow device associated with said exit means to vary the flow through said exit means.

12. The system of claim 11 wherein said selectively variable flow device associated with said exit means includes an arcuately segmental device.

13. The system of claim 2 further comprising means for closing off the flow of cold air from the refrigeration means to the housing.

14. The system of claim 2 wherein said secondary flow path means includes a vertical conduit formed at the center of the conveyor and extending along the conveyor's axial length.

15. The system of claim 2 wherein the conveyor is driven by a centrally located rotating drum, said drum providing part of said secondary flow path means.

16. The system of claim 2 wherein said belt includes a plurality of apertures through which air can flow.

17. A helical conveyor system for cooling or freezing a product comprising:

a conveyor for conveying the product, said conveyor including a belt in the form of a helix with a plurality of turns and having a top and a bottom;

a housing enclosing the conveyor, said housing having side walls and a top and a bottom;

refrigeration means for providing cold air;

primary flow path means in communication with said refrigeration means for directing a primary flow of cold air into the housing and upwardly from the bottom of the conveyor through turns of the conveyor;

secondary flow path means in communication with said refrigeration means for directing a secondary flow of cold air along a flow path different than the primary flow path to the top of the conveyor and downwardly through a plurality of upper turns of the conveyor where the secondary flow merges with said primary flow; and exit means formed in a side wall of the housing through which the cold air flows out of the housing.

18. The system of claim 17 further comprising, a first selectively variable device for controlling flow into said housing, said device being positioned below the bottom of said conveyor; and a second selectively variable flow device associated with said exit means to vary the flow through said exit means.

19. The system of claim 17 wherein said belt includes a plurality of apertures through which air is flowable.

20. A helical conveyor system for cooling or freezing a product comprising:

a conveyor for conveying the product, said conveyor including a belt in the form of a helix with a plurality of turns and having a top and a bottom;

a housing enclosing the conveyor, said housing having side walls and a top and a bottom;

refrigeration means for providing cold air;

primary flow path means in communication with said refrigeration means for directing a primary flow of cold air into the housing and upwardly from the bottom of the conveyor through turns of the conveyor;

secondary flow path means in communication with said refrigeration means for directing a secondary flow of cold air along a flow path different from the primary flow path to the top of the conveyor, said secondary flow path means including a vertical conduit formed at the center of the conveyor and extending along the conveyor's axial length; and exit means formed in the housing through which the cold air flows out of the housing after it has been directed along the primary and secondary flow paths.

21. The system of claim 20 wherein said secondary flow path means causes the secondary flow to pass through the vertical conduit, over the top of the conveyor, and downwardly through a plurality of upper turns of the conveyor to a position where the secondary and primary flows merge.

22. The system of claim 20 further comprising a first means and a second means for controlling the primary and secondary flows of cold air.

23. The system of claim 22 wherein, said first controlling means includes an adjustable ring diaphragm for selectively varying the flow of the cold air, said diaphragm being positioned between the bottom of the housing and the bottom of the drum; and said second controlling means includes an arcuately segmental plate for selectively varying the flow of the cold air, said plate being associated with said exit means.

24. The system of claim 20 further comprising an internal, rotatable drum for driving said conveyor and wherein said drum forms said vertical conduit.

25. In a helical conveyor system including a helical conveyor with a top and a bottom, refrigeration means for providing cold air, and a housing enclosing the conveyor having an exit means, a process for cooling or freezing a product comprising the steps of:

transporting the product using said conveyor from the bottom to the top of the conveyor;

introducing a first flow of cold air to the bottom of the conveyor so that it flows in a first path under and around the product from the bottom of the conveyor;

simultaneously introducing a second flow of cold air to the top of the conveyor so that it flows in a second path over and around the product from the top of the conveyor; and expelling both the first flow and second flow of cold air from the housing through the exit means after the first flow and second flow have passed by the product.

26. The process of claim 25 further comprising the step of merging together the first flow and second flow of cold air immediately prior to the step of expelling the first flow and second flow from the housing.

27. The process of claim 25 wherein said step of simultaneously introducing a second flow of cold air includes using said second path including a vertical conduit formed at the center of the conveyor and extending along the conveyor's axial length.

28. The process of claim 25 wherein said expelling step includes expelling the first flow and second flow of cold air through said exit means located intermediate to the top and bottom of said conveyor.

29. The process of claim 25 further comprising the step of controlling air flowing into the housing using a selectively variable device.

30. The process of claim 25 further comprising the step of controlling air flowing out of the housing using a selectively variable device.

* * * * *